US005592700A

United States Patent [19]

Genesse

[11] Patent Number: 5,592,700

[45] Date of Patent: Jan. 14, 1997

[54] AUTOMATIC TOILET LID CLOSER

[75] Inventor: Bryan V. Genesse, Granada Hills, Calif.

[73] Assignee: Genovative Concepts International LLC, Granada Hills, Calif.

[21] Appl. No.: 620,667

[22] Filed: Mar. 26, 1996

[51] Int. Cl.[6] ..... A47K 13/10

[52] U.S. Cl. ..... 4/246.1; 4/248

[58] Field of Search ..... 4/408, 409, 249, 4/250, 246.1, 248, 661

[56] References Cited

U.S. PATENT DOCUMENTS

| | | | |
|---|---|---|---|
| 3,579,664 | 5/1971 | Johnson | 4/250 |
| 4,491,989 | 1/1985 | McGrail | 4/250 |
| 4,519,105 | 5/1985 | Blanck | 4/246.1 |
| 4,839,928 | 6/1989 | Probasco | 4/246.1 |
| 5,060,318 | 10/1991 | Jaskiewicz | 4/248 |
| 5,430,897 | 7/1995 | Lavender | 4/246.1 |

*Primary Examiner*—Henry J. Recla
*Assistant Examiner*—Charles R. Eloshway
*Attorney, Agent, or Firm*—Albert O. Cota

[57] ABSTRACT

An automatic toilet lid closer having a spring-loaded sloped edge arm (30) pivotally attached to an adjustable mounting pedestal (52) that attaches to a side of a toilet water tank (50), The arm (30) swings outwardly when urged by the rotation of the toilet's flush handle (38) upon the sloped edge transferring movement from a vertical to a horizontal direction. The horizontal movement pivots the arm into contact with the toilet lid (86) sufficiently to cause the lid to fall from its at-rest position into a closed position. Resilient cushions (90) break the fall of the lid and dampen the noise. A second embodiment utilizes an electromagnetic solenoid (98) to provide the movement to close the lid (86) and a third embodiment employs a lever bar (106) wedged under a hinged lever arm (104) to change downward force to an outward direction for lid closure.

17 Claims, 3 Drawing Sheets

AUTOMATIC TOILET LID CLOSER

TECHNICAL FIELD

The invention pertains to the general field of toilet seat closers and more specifically to closers that automatically close the lid of a toilet bowl when the toilet tank is flushed.

BACKGROUND ART

Ever since the invention of the indoor toilet there has been a well-known and long-standing problem resulting from the anatomical difference between men and women. For a particular use, men place the toilet's seat in an upward position, while women must always place the seat in the downward position. These divergent practices have caused generations of women to suffer shock, discomfort and in some instances injury, because prior to sitting on the toilet, they assumed the seat was in the downward position.

Most men are aware of this toilet seat problem and, although they do not deliberately subject a woman to pain or discomfort, the problem continues to exist. Therefore, it is evident that some men are not conditioned or otherwise motivated to place the toilet seat in its downward position once they have completed using the toilet.

Another problem which results from a toilet seat remaining in the upward position, is that the water in the toilet bowl is exposed. Many toddlers and younger children are fascinated by toilets, due to the importance a parent will stress on the child's use of a toilet and the child's natural curiosity. Unfortunately, it has been proven that a child can drown in water that is only two or three inches in depth. If a child happens to climb over the edge of a toilet bowl he or she can easily slip and fall into the toilet bowl. If the child is not found quickly, he or she may die or suffer severe injuries.

Yet another problem, though less serious, is that exposed toilet water is often consumed by household pets, such as dogs. Whereas this is not as much a major problem, as it is a nuisance, there have been cases where an individual has forgotten to flush after relieving themselves and a pet has drank from the toilet bowl with waste present. A pet can get very sick and often must be taken to a veterinarian, thus incurring a significant monetary charge. Exposed toilet bowls also allow odors to emanate from the bowl. These odors produce bacteria that when inhaled can be detrimental to human health.

It is important to note that any of the above described scenarios may be avoided or at least minimized, if only the toilet bowl is kept closed at all times when it is not being used.

A search of the prior art did not disclose any patents that read directly on the claims of the instant invention, however the following U.S. patents are considered related:

| U.S. Pat. No. | INVENTOR | ISSUED |
|---|---|---|
| 5,369,814 | Denys | 6 December 1994 |
| 3,781,924 | Davis, Jr. | 1 January 1974 |
| 1,907,826 | Kapp | 9 May 1933 |
| 475,170 | Webster | 17 May 1892 |

The U.S. Pat. No. 5,369,814, Denys patent discloses an automatic toilet seat lowering mechanism. The mechanism is composed of a water pressure sensor connected with the water supply to the toilet. A seat closure unit effects the automatic closing of the toilet seat, with a regulated rate of descent. Mechanical linkage, between the water pressure sensor and the seat closure unit, automatically actuates closure of the toilet seat when the water pressure sensor detects a drop in line pressure resulting from the commencement of the toilet flushing.

The U.S. Pat. No. 3,781,924 Davis Jr. patent discloses a toilet lid or lid and seat closer device for tank-type toilets. The device utilizes pneumatic means, which are actuable upon flushing of the toilet, for moving the raised toilet lid or lid and seat from a position behind the vertical to a position forward of the vertical. Gravity restraining means allow for a gradual lowering of the toilet lid or lid and seat to the closed position.

The U.S. Pat. No. 1,907,826 Kapp patent discloses an automatic toilet closure. The automatic toilet seat closure consists of a toilet lid hinged to its support in an off-center manner, so that it will tend to fall, even when it is in an upright position. An elastic catch holds the lid in an upright position and a means, such as a string, transfers the motion of flushing to the elastic catch. The motion causes the elastic catch to be released, thereby causing the lid to fall. A counter-balancing medium acts to effect a noiseless dropping of the lid.

The U.S. Pat. No. 475,170 Webster patent discloses a device for automatically closing the covers of toilet bowls or other receptacles. The device operates by the combined action of a metallic spring and an air-cushioning cylinder piston. Through the intervention of suitable levers and connections with the above described elements, the device allows the automatic losing of the toilet bowl cover.

For background purposes and as indicative of the art to which the invention is related reference may be made to the remaining cited patents:

| U.S. Pat. No. | INVENTOR | ISSUED |
|---|---|---|
| 2,842,779 | Zulkoski | 15 July 1958 |
| 2,214,323 | Carter | 10 September 1940 |
| 481,498 | Kremelberg | 23 August 1892 |

DISCLOSURE OF THE INVENTION

At the present time the use of toilets for the disposal of human waste is universal in most developed countries. In many residences, the toilet consists of a water tank mounted onto a toilet bowl with a hinged seat and lid combination to conceal the water contained in the toilet bowl. The normal procedure for using a toilet is to lift the lid for use and then manually close the lid after flushing the toilet. In the case of a male, both the seat and lid are lifted when urinating and closed as a unit. In any event, touching the bottom of the seat or lid to place either or both in their lower position may be repugnant to some persons and, to many, a bothersome act.

In its most basic design, the automatic toilet lid closer that functions with a toilet bowl having a hinged toilet lid that is in an open vertical position or a closed horizontal position, and a water tank having pivotally attached to a side, a toilet flush handle. The closer is comprised of a closer arm having means for attaching the arm to the toilet tank contiguous with the toilet flush handle. When the flush handle is not depressed, the closer arm does not effect the lid, allowing the lid to remain in an open vertical position. Conversely, when the flush handle is depressed, it causes the closer arm to be displaced forward which subsequently causes the lid to be urged forward sufficiently to cause the lid to fall to the closed position.

In view of the above disclosure, it is the primary object of the invention to offer a device that attaches on the water tank to effect the automatic closure of the toilet lid each time the toilet is flushed. This is accomplished in one embodiment by a sloped edge angular arm that attaches to the side of the tank and a beveled portion in contact with the flush lever handle that moves the arm outwardly, pushing the lid downward to the closed position. The angular arm thus converts the downward motion of the flush handle into outward motion with no additional effort of the user.

when the lid is pushed, it falls by gravity with some force. However, the falling shock is absorbed by the addition of resilient cushions that are added to the bottom surfaces immediately surrounding the existing pads typically found on the bottom of the seat and lid for that very purpose.

The cushions are made of a soft resilient material that yields at a slow rate, cushioning the impact and dampening the noise. An alternate embodiment incorporates the use of a hollow cushion that works as an air dampener, as the air inside must flow from a small hole on the side. Upon impact, the hollow interior expands and air is expelled through the orifice until the lid or seat rest upon the existing pads. When the lid or seat is raised, the resilience of the cushion draws air into the interior to equalize the force exerted by the memory of the material shape.

An important object of the invention is the ability of the device to be flexible and adjustable to fit most toilets. As there is no industry standard shape, size or location of the flush handle, the invention is adapted to fit the majority of water tanks by mounting near the back edge of the tank, nearest the flush handle. This means that if the handle is on the front or on the side, the device may be adjusted to operate properly. This adjustment is accomplished by locating the pivot point either closer or further from the tank by simply choosing the appropriate hole or sliding the pivot pin within a slot.

In another embodiment, the mounting pedestal may include a detent extension for positioning the pivot pin in the optimum place. A further adjustment to the actual shape of the arm is accomplished using an extended nib with a radial tongue that interfaces with a bifurcated jaw in the extended end of the arm. By rotating the outermost end, the exact amount of movement may be made by the arm to push the lid downward without undue force or overtravel.

Another object of the invention is its ability to be installed onto a toilet water tank with no modifications. This attachment is accomplished by the utilization of a suitable structural adhesive. Since the tank is normally made of vitreous china with a smooth, hard surface and the pedestal is fabricated of uniformly flat thermoplastic or metal, the use of a structural adhesive, double-sided foam tape or hook and loop tape is preferred. In another embodiment, a suction cup may also be used to anchor the pedestal to the tank or alternatively a hook may be employed that loops over the top edge of the tank and grasps the wall tightly, providing a mounting base for the pedestal.

Still another object of the invention is the removability of the device that permits removal of the invention at anytime from the toilet.

Since the only elements attached directly to the toilet are the pedestal and cushions, which are both attached by adhesive or the like, removal is easy and essentially effortless, leaving only slight residue that may be removed. As no modification to the toilet is necessary for the installation, removal leaves the toilet in its original condition.

Yet another object of the invention is its simplicity and cost effectiveness from both a manufacturers and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred, second and a third embodiment. All three embodiments are designed to automatically close a toilet lid each time the toilet flush handle is depressed. The first and third embodiments utilize mechanical principles to move the toilet lid and the second embodiment uses electromagnetic forces for the lid movement.

Figure 9:
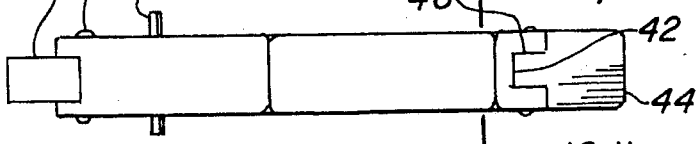
FIG. 9 is a front view of the preferred embodiment.
Figure 10:
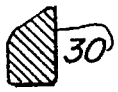
FIG. 10 is a cross sectional view taken along the lines 10—10 of FIG. 9 showing the slope on one edge of the arm.
Figure 11:
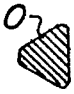
FIG. 11 is a cross sectional view taken along the lines 11—11 of FIG. 9 depicting a slope on both edges of the arm.

The preferred embodiment, as shown in FIGS. 1–21 is comprised of a sloped edge angular arm 30 having a first end 32 containing pivot means and the second end 34 having angular adjustment means. The arm 30 is illustrated best in FIGS. 7, 9 and 12 and contains preferably two angular bends 36 integral with the arm 30 permitting the shape of the arm to fit both side and front mounted toilet flush handles 38 interchangeably, with only one arm 30 configuration. The sloped edge of the arm 30 is either formed as an acute angle on the side, contiguous with the flush handle 38, as shown in FIG. 10, or has an identical but reverse angle underneath forming a triangular shape 40, depicted in FIG. 11. Either embodiments function equally well, as the slope on the top has the functional characteristic necessary for operation of the closer.

The second end 34 angular adjustment of the arm 30 consists of a bifurcated jaw 42 integral with the arm 30 and a separate extended nib 44, which includes a radial tongue 46 that nests into the jaw 42 and is pivotally secured with a compressible pin 48 in the form of a machine screw and nut, or the like. This arcuate union permits the nib 44 to be rotated to a specific angular displacement for a given toilet configuration and when set, tightened by the screw and nut into a rigid joint. This adjustment compensates for differences in water tank 50 design and permits the arm 30 to be custom fitted when installed. The arm 30 may be made of any suitable material such as metal, wood or fiberglass, with thermoplastic being preferred.

Figure 7:
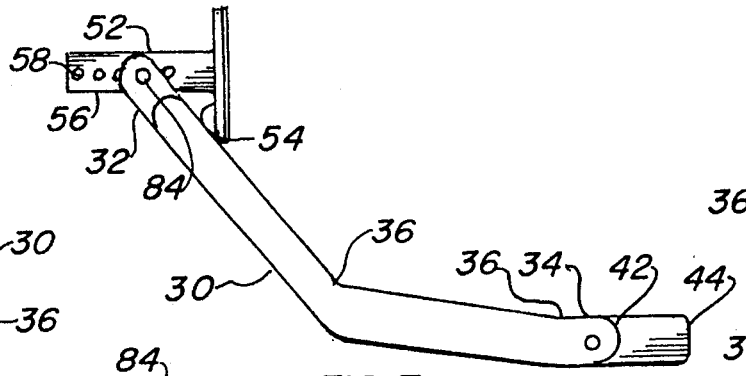
FIG. 7 is a top plan view of the preferred embodiment.
Figure 8:
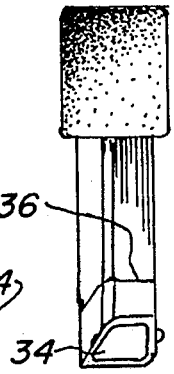
FIG. 8 is a inner side view of the preferred embodiment.
Figure 12:
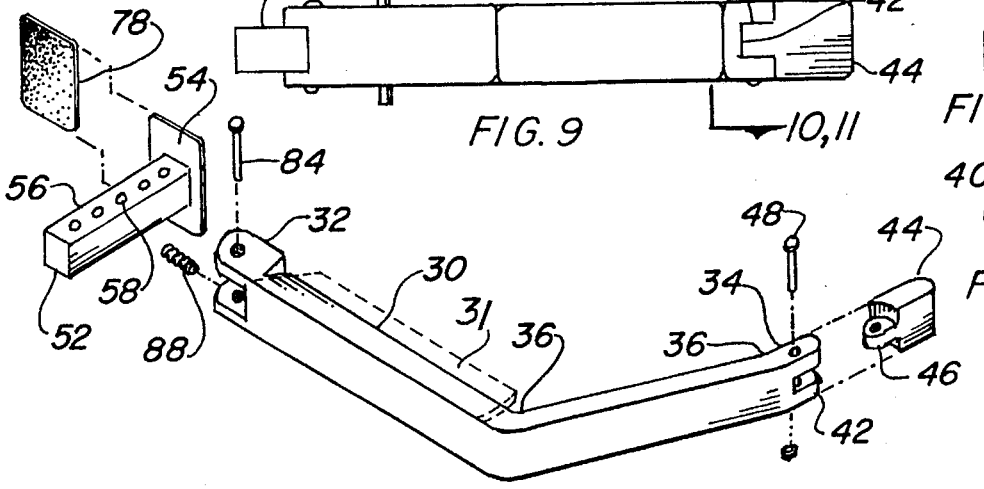
FIG. 12 is an exploded perspective view of the preferred embodiment less the cushions completely removed from the invention for clarity.
Figure 13:
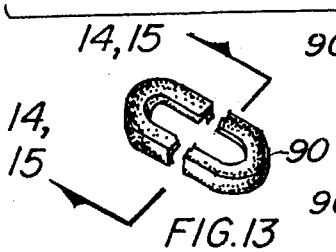
FIG. 13 is a partial perspective view of the elongated cushions completely removed from the invention for clarity.

An adjustable mounting pedestal 52 is fastened by an attachment means to the toilet water tank 50 and is superimposed with the arm first end 32. This pedestal 52 is illustrated in the preferred embodiment, in FIGS. 6–9 and 12, and consists of a mounting base 54 that has a horizontal arm 56 attached thereunto. This arm 56 contains the means to join the arm 50 in an adjustable manner, preferably consisting of a plurality of pin receiving holes 58 that penetrate completely through, as shown in FIGS. 7 and 12, and are located on the top portion in a linear manner. The mounting base 54, as shown in FIG. 12, is preferably in a rectangular shape. However, any shape that best conforms to the contour and/or shape of the toilet tank can be utilized.

Figure 20:
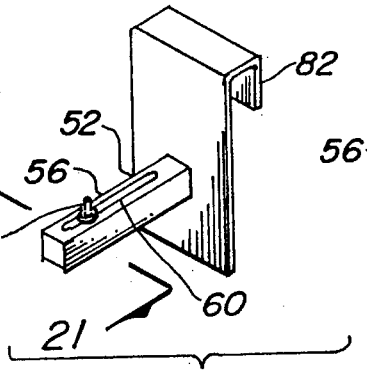
FIG. 20 is an exploded perspective view of the mounting pedestal in the slotted and hooked embodiment completely removed from the invention for clarity.
Figure 21:
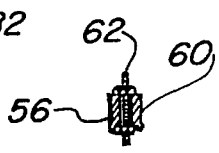
FIG. 21 is a cross sectional side view taken along the lines 21—21 of FIG. 20 with a threaded pivot pin installed.

Another arm joining design is illustrated in FIGS. 20 and 21. In this design, a slot 60 through the arm 56 and a threaded pin 62, with a pair of nuts or a threaded pin with shoulder and a single nut, are employed. This combination compressibly positions the pin at an appropriate location for a specific water tank configuration.

Figure 19:
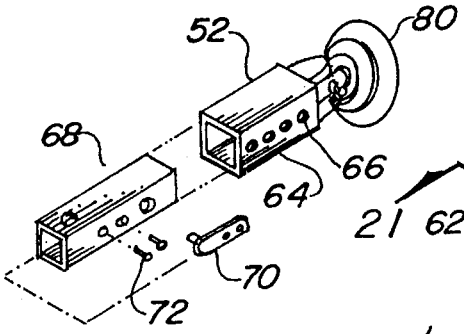
FIG. 19 is an exploded perspective view of the mounting pedestal in the telescoping embodiment completely removed from the invention for clarity.

In FIG. 19 is further depicted another arm joining design, wherein the entire arm 56 is adjustable. This adaption includes a female section 64 that has a plurality of bores 66 in one side and a telescoping section 68 that employs a spring-loaded detent 70 attached inside with fasteners 72. This combination allows the length to be adjusted by inserting the telescoping section 68 into the female section 64 at an appropriate location and locking it into position with the detent 70 penetrating the appropriate bore 66.

Figure 1:
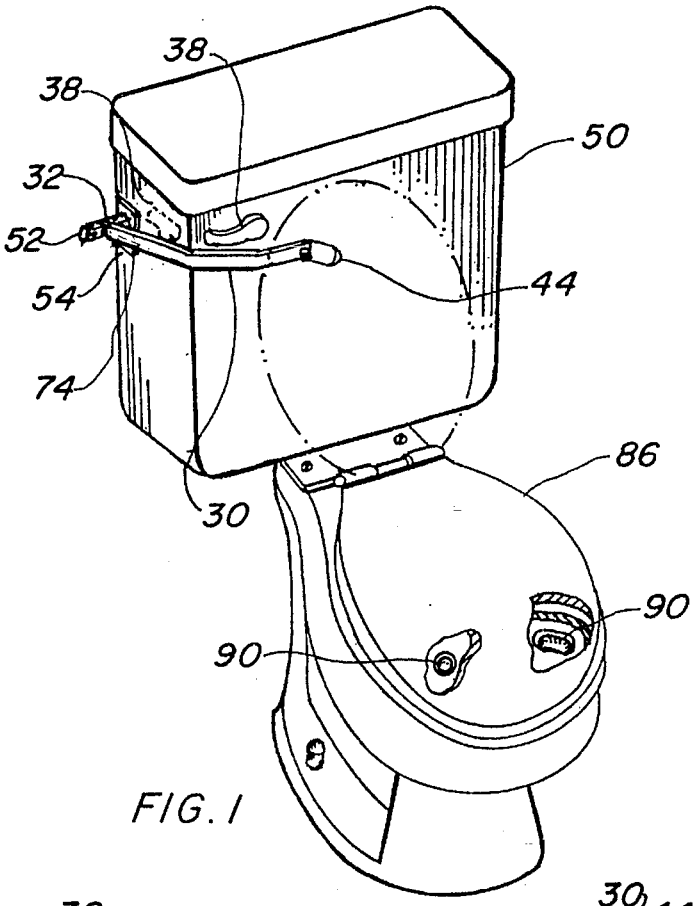
FIG. 1 is a perspective view of the preferred embodiment installed on a typical toilet tank.
Figure 2:
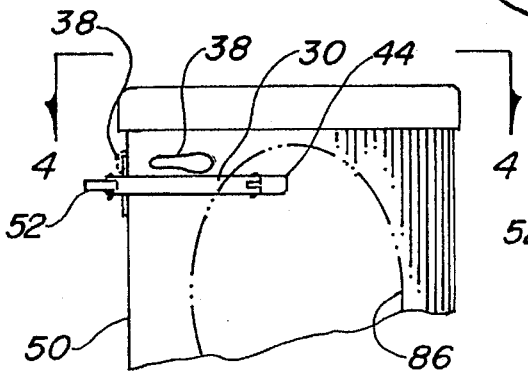
FIG. 2 is a partial front elevational view of the preferred embodiment in its normal at rest position.
Figure 3:
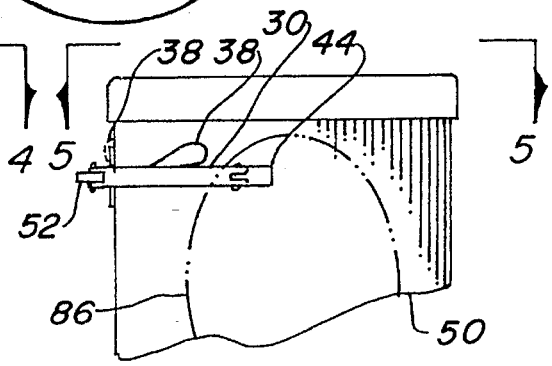
FIG. 3 is a partial front elevational view of the preferred embodiment in its flushed position.
Figure 4:
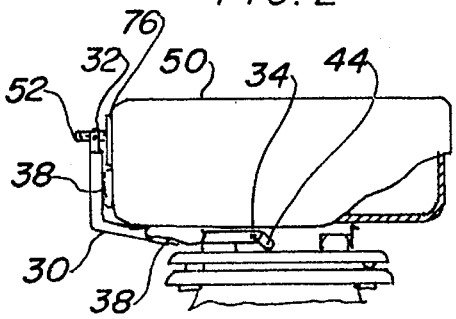
FIG. 4 is a top plan view of the preferred embodiment in its normal at rest position.
Figure 5:
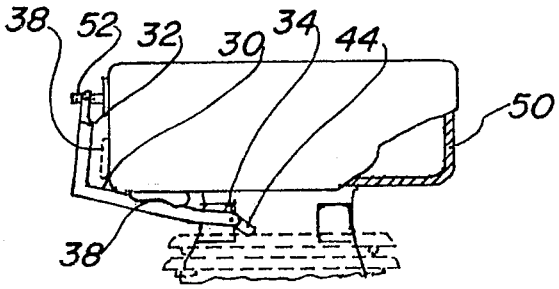
FIG. 5 is a top plan view of the preferred embodiment in its flushed position with the seat shown dotted as it has been pushed over the center of gravity.
Figure 6:
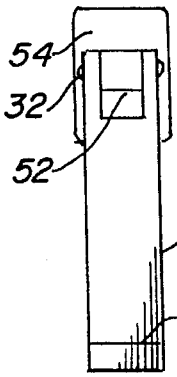
FIG. 6 is a fragmentary outer side view of the preferred embodiment.

The mounting pedestal 52, in all of its designs, is attached to the water tank 50 by attachment means which include either structural adhesive 74, as shown in FIG. 1, double-sided foam tape depicted in FIG. 4, hook and loop tape illustrated in FIG. 12 or a suction cup 80 shown in FIG. 19. Further, a hook 82 integral with the mounting base 54, as shown in FIG. 20, may jointly hook over the upper edge of the tank 50 and compress the wall inbetween for stability and adherence. The pedestal 52 may be of the same material as the arm 30.

In any event the arm 30 is attached to the pedestal 52 in all its embodiments, except as shown in FIGS. 20 and 21, by a pivot pin 84 penetrating both members that permits the arm to move in an arc and swing outwardly when the flush handle 38 is depressed. The movement is caused by the end of the toilet flush handle 38 contacting the sloped edge of the arm 30. This contact transfers movement direction from vertical to a horizontal, which pivots the arm about the pin 84 into contact with the toilet lid 86 to effect the downward movement and subsequent closed position. In some toilet tank shapes and/or dimensions it may be necessary to increase the width of the sloped section of the angular arm 30. This is easily accomplished by attaching, by an attachment means, a slope extending section 31 to the sloped section of the arm 30, as shown in FIG. 12. The increased slope width allows the toilet flush handle 38 to make contact with and move the arm 30 in the required horizontal direction.

It will be noted that the lid 86, or combination of lid 86 and seat, are at rest when opened slightly over the center of gravity, which maintains the open position. Only a slight movement with little force is required to urge the lid 86 over the center of gravity and fall closed.

Spring means preferably in the form of a compression spring 88 or the like, return the arm 30 to the at-rest position after flushing and lid closing is completed. The spring 88 may be inserted into an aperture in the arm 30 or may be attached externally, both methods of attachment are well known in the art.

As the lid 86 may be made of a dense material, the weight and mass may cause an objectional noise when the existing bumpers strike the rim of the toilet bowl. Cushion means, which are made of a resilient material, are included in the invention to break the fall of the lid 86. The cushion means include a multi-shaped cushion 90 basically conforming to the existing toilet lid and seat bumpers. The resilient material may be any type of plastic suitable for the application in a solid or foamed formulation. While any thermoplastic or thermoset material may produce the desired characteristics with vinyls being preferred for their flexibility. This selected group would contain fifty percent or more polyvinyl chloride with plasticizers, fillers, stabilizers etc. added to the base resins to form a soft yet resilient material that would dampen the shock and reduce the noise.

Figure 14:
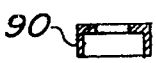
FIG. 14 is a cross sectional view taken along the lines 14—14 of FIG. 13 illustrating the resilient material embodiment.
Figure 15:
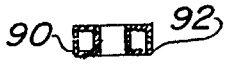
FIG. 15 is a cross sectional view taken along the lines 15—15 of FIG. 13 illustrating the air damper embodiment.
Figure 16:
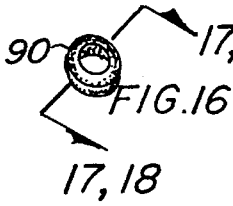
FIG. 16 is a partial perspective view of the round cushion completely removed from the invention for clarity.
Figure 17:
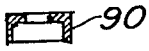
FIG. 17 is a cross sectional side view taken the along lines 17—17 of FIG. 16 illustrating the resilient material embodiment.
Figure 18:
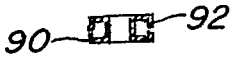
FIG. 18 is a cross sectional side view taken along the lines 18—18 of FIG. 16 illustrating the air damper embodiment.

The configuration of these cushions 90, as shown in FIGS. 13–18, conform to existing bumpers and may be angular, as depicted in FIGS. 14 and 17, or included as an air cushion 92, with a hollow chamber filled with air and a small vent to dispel the air slowly when compressed. Other configurations and materials will function equally well and be within the scope of this invention.

In operation, the lid 86 of the toilet is raised manually and remains open until the toilet flush handle 38 is depressed. The rotation of the handle forces the arm 30 outward, pushing the seat closed. When installing the invention, adjustments may be made in arm shape and position of the pivot point and height, relative to the flush handle 38 to accommodate the particular toilet and side or front location of the handle.

Figure 22:
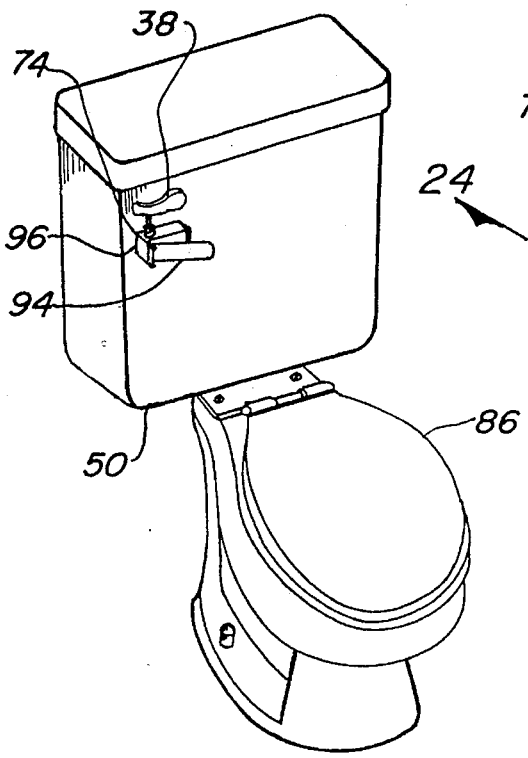
FIG. 22 is a perspective view of the second embodiment installed on a typical toilet.
Figure 23:
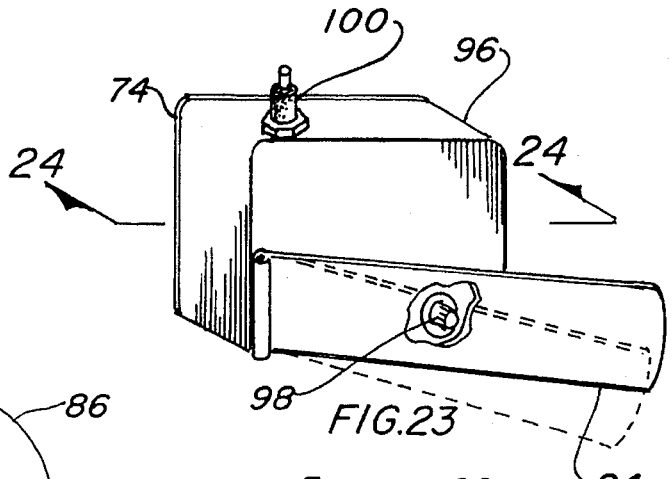
FIG. 23 is a partial perspective view of the electromechanical toilet seat closer.
Figure 24:
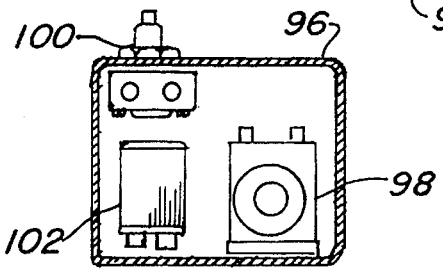
FIG. 24 is a cross sectional top view taken along lines 24—24 of FIG. 23.
Figure 25:
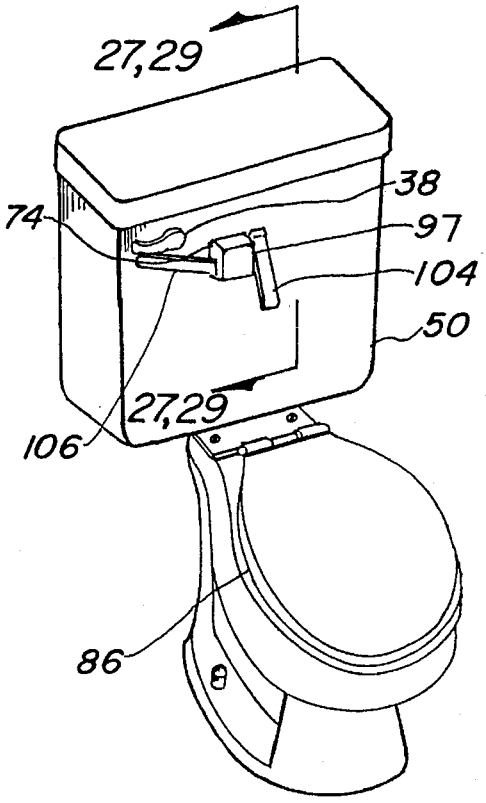
FIG. 25 is a perspective view of the third embodiment installed on a typical toilet.
Figure 26:
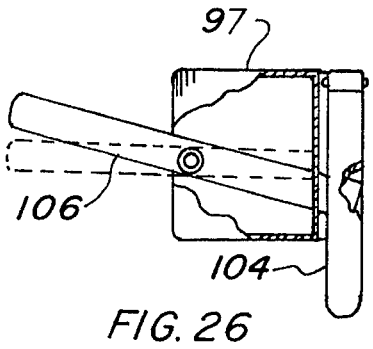
FIG. 26 is a front elevational view partially cutaway to illustrate the elements inside which are shown in the toilets normal at rest position.
Figure 27:
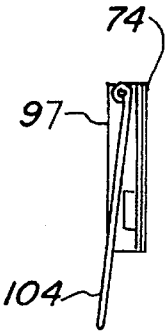
FIG. 27 is a right side view of the FIG. 25 view shown in the toilet's normal at rest position.
Figure 28:
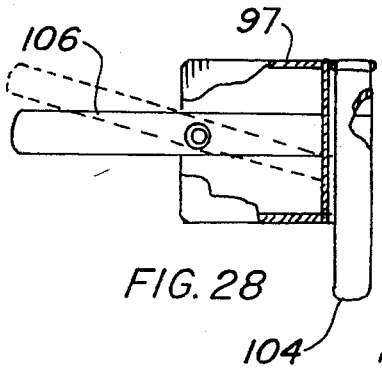
FIG. 28 is a front elevational view partially cutaway to illustrate the elements inside which are shown in the toilet's flushed position.
Figure 29:
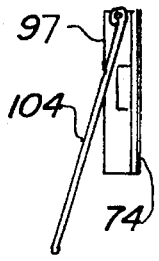
FIG. 29 is a right side view of the FIG. 25 view shown in the toilet's flushed position.

The second embodiment, depicted in FIGS. 22–24, includes a pivoted lever arm 94 arcuately attached to a base 96. An electromagnetic solenoid 78 mounted to the base pushes the solenoid arm 94 outward against the lid for closure. A switch 100 is electrically connected to the solenoid 98 and a power source, preferably a battery 102, furnishes electric power to the solenoid. The same cushion means as in the preferred embodiment breaks the fall of the lid 86. The base is fastened to the toilet tank 30 with the same attachment means as the pedestal 52. The base 96 is installed such that the switch 100 interfaces with the flush handle 38 and when flushed, closes the switch, energizing the solenoid 98. While a battery 102 is preferred, household power may also be used.

The third embodiment is illustrated in FIGS. 25–29 and includes a base 97, attached in the same manner as above, that arcuately receives a hinged lever arm 104 for moving the lid 86 over the center of gravity. A flush handle lever bar 106 is pivotally attached to the base 77 and a first end is contiguous with the flush handle 38. A second end is disposed between the base 97 and the hinged lever arm 104, as illustrated best in FIGS. 27 and 29. When the flush handle 38 is depressed, it moves the first end down and the second end up, wedging the second end against the arcuately attached end of the hinged arm 104 forcing it outward and urging the lid 86 closed. While this embodiment is illustrated for a tank 50 with the handle 38 on the front, the device may be used on a side handle toilet by bending the lever bar 106 into a shape that is in contact with the handle. The same cushion means are utilized as in the preferred embodiment, as depicted in FIGS. 1 and 13–18.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. An automatic toilet lid closer for a toilet having a flush handle on a water tank and a hinged toilet lid, said closer comprising:

(a) a closer arm consisting of a sloped edge angular arm having a first end and a second end with the first end containing a pivot means;

(b) an adjustable mounting pedestal adapted to be fastened with an attaching means to the toilet water tank;

(c) a pivot pin attaching the pivot means to the pedestal permitting the arm to swing outwardly when said flush handle is rotated to flush said toilet, said handle, when rotated, contacting the sloped edge of said arm thereby pivoting the arm into contact with the toilet lid sufficiently to make the lid fall into a closed horizontal position; and, (d) cushion means, adapted for connection to said lid, to break the fall of the lid to the toilet.

2. The automatic toilet lid closer as recited in claim 1 wherein said angular arm further comprises at least two angular bends along the arm permitting interface with both side and front mounted flush handles interchangeably.

3. The automatic toilet lid closer as recited in claim 1 wherein said sloped edge of the angular arm further comprises an acute angle on a side facing the flush handle.

4. The automatic toilet lid closer as recited in claim 1 wherein said sloped edge of the angular arm further comprises an angle on a side facing the flush handle and an identical but reverse angle extending from said sloped edge thereby forming a triangular shape arm.

5. The automatic toilet lid closer as recited in claim 1 wherein said arm second end further comprises an angular adjustment further comprising a bifurcated jaw in the arm and an extended nib having a radial tongue, with the tongue interfacing into the jaw and a compressible pin arcuately maintaining a union therebetween permitting the nib to be rotated into a specific angular displacement for a given toilet configuration and tightened into a rigid joint.

6. The automatic toilet lid closer as recited in claim 5 wherein said compressible pin further comprises a threaded fastener in the form of a machine screw and nut.

7. The automatic toilet lid closer as recited in claim 1 wherein said adjustable mounting pedestal further has a plurality of pivot pin receiving holes penetrating therethrough for selectively receiving the pivot pin at an appropriate location for a specific water tank configuration.

8. The automatic toilet lid closer as recited in claim 1 wherein said adjustable mounting pedestal further has a slot penetrating therethrough and a threaded pivot pin with at least one nut to compressibly position the pin at an appropriate location for a specific water tank configuration.

9. The automatic toilet lid closer as recited in claim 1 wherein said adjustable mounting pedestal further has a female section having a plurality of bores in one side and a telescoping section having a spring loaded detent therein such that an extended length may be adjusted by inserting the telescoping section into the female section to an appropriate location for a specific water tank configuration and locking into position with the detent penetrating an appropriate bore.

10. The automatic toilet lid closer as recited in claim 1 wherein said attaching means comprises structural adhesive.

11. The automatic toilet lid closer as recited in claim 1 wherein said attaching means comprises double sided foam tape.

12. The automatic toilet lid closer as recited in claim 1 wherein said attaching means comprises book and loop tape.

13. The automatic toilet lid closer as recited in claim 1 wherein said attaching means comprises a suction cup.

14. The automatic toilet lid closer as recited in claim 1 wherein said attaching means comprises a hook adapted to be disposed over an upper edge of the tank side wall.

15. The automatic toilet lid closer as recited in claim 1 further comprising a slope extending section attached, by an attachment means, to the sloped edge of said angular arm.

16. The automatic toilet lid closer as recited in claim 1 wherein said cushion means comprises a multi-shaped cushion adapted for conforming to existing toilet lid and seat bumpers and formed of a resilient material.

17. The automatic toilet lid closer as recited in claim 1 wherein said cushion means comprises a hollow air cushion adapted for conforming to existing toilet lid and seat bumpers and formed of a resilient material.

* * * * *